US010716195B2

(12) United States Patent
Meerbeek et al.

(10) Patent No.: US 10,716,195 B2
(45) Date of Patent: Jul. 14, 2020

(54) LIGHTING SYSTEM FOR CONTROLLING AN LED ARRAY

(71) Applicant: SIGNIFY HOLDING B.V., Eindhoven (NL)

(72) Inventors: Berent Willem Meerbeek, Eindhoven (NL); Markus Jozef Maria Kurvers, Eindhoven (NL); Bartel Marinus Van De Sluis, Eindhoven (NL); Bas Driesen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/474,395

(22) PCT Filed: Dec. 15, 2017

(86) PCT No.: PCT/EP2017/083080
§ 371 (c)(1),
(2) Date: Jun. 27, 2019

(87) PCT Pub. No.: WO2018/122009
PCT Pub. Date: Jul. 5, 2018

(65) Prior Publication Data

US 2019/0342983 A1 Nov. 7, 2019

(30) Foreign Application Priority Data

Jan. 2, 2017 (EP) ..... 17150001

(51) Int. Cl.
*G05F 1/00* (2006.01)
*H05B 37/02* (2006.01)
(Continued)

(52) U.S. Cl.
CPC ..... *H05B 47/19* (2020.01); *H05B 45/20* (2020.01)

(58) Field of Classification Search
None
See application file for complete search history.

(56) References Cited

U.S. PATENT DOCUMENTS 7,889,051 B1 2/2011 Billig et al.
2011/0053492 A1* 3/2011 Hochstein ..... H05B 37/0272 455/7
(Continued)

FOREIGN PATENT DOCUMENTS

EP 2785006 A1 10/2014
EP 3079447 A1 10/2016
(Continued)

*Primary Examiner* — Anh Q Tran
(74) *Attorney, Agent, or Firm* — Akarsh P. Belagodu

(57) ABSTRACT

A lighting system (100) for controlling an LED array (102) is disclosed. The lighting system (100) comprises the LED array (102) comprising a plurality of individually addressable light sources L1-L15 each having an individual address, a processor (104) configured to divide the plurality of individually addressable light sources L1-L15 into a plurality of segments (110, 112, 114) of light sources by assigning segment addresses to the segments (110, 112, 114) of light sources, wherein each segment comprises a unique set of one or more light sources, wherein the LED array (102) further comprises a receiver (106) configured to receive a plurality of lighting control signals via a network (150), wherein each lighting control signal is addressed to one of the segment addresses, and wherein the LED array (102) further comprises a controller (108) configured to control at least one of the individually addressable light sources of each segment according to the lighting control signal addressed to the respective segment.

13 Claims, 4 Drawing Sheets

(51) Int. Cl.

| | |
|---|---|
| ***H05B 39/04*** | (2006.01) |
| ***H05B 41/36*** | (2006.01) |
| ***H05B 47/19*** | (2020.01) |
| ***H05B 45/20*** | (2020.01) |

(56) References Cited

U.S. PATENT DOCUMENTS

| | | | |
|---|---|---|---|
| 2014/0168610 | A1 | 6/2014 | Spaulding et al. |
| 2014/0333207 | A1 | 11/2014 | Saes |
| 2015/0048758 | A1 | 2/2015 | Carrigan et al. |
| 2015/0204487 | A1 | 7/2015 | Scapa et al. |
| 2016/0123541 | A1 | 5/2016 | Quilici et al. |

FOREIGN PATENT DOCUMENTS

| | | | | |
|---|---|---|---|---|
| WO | 2014024078 | A1 | 2/2014 | |
| WO | 2016009324 | A1 | 1/2016 | |
| WO | 2016046005 | A2 | 3/2016 | |
| WO | WO-2016046005 | A3 * | 5/2016 | ..... H04L 12/00 |
| WO | 2016096615 | A1 | 6/2016 | |

* cited by examiner

LIGHTING SYSTEM FOR CONTROLLING AN LED ARRAY

CROSS-REFERENCE TO PRIOR APPLICATIONS

This application is the U.S. National Phase application under 35 U.S.C. § 371 of International Application No. PCT/EP2017/083080, filed on Dec. 15, 2017, which claims the benefit of Patent Application No. 17150001.0, filed on Jan. 2, 2017. These applications are hereby incorporated by reference herein.

FIELD OF THE INVENTION

The invention relates to a lighting system for controlling an LED array. The invention further relates to a method of controlling an LED array, and a computer program for executing the method.

BACKGROUND

Connected home lighting systems comprise different types of connected lighting devices. These devices are often controlled with a remote control device, such as a smartphone. A user may select a light setting or a lighting scene (i.e. light instructions for one or more lighting devices) on a smart phone, whereupon the selected light setting or light setting is communicated to the lighting device(s) via a (wireless) network. The smart device may communicate directly or via a hub or a bridge with the lighting device(s). Examples of such lighting devices are portable lighting devices, LED lamps and LED strips.

An LED strip is a (flexible) array of light sources, which light sources are typically controlled by a controller comprised in the LED strip. The controller may receive lighting control signals from a smart device and control the LED strip based thereon. Recent developments in LED strips enable individual control of the light sources of the LED strip. This enables a user to generate a light scene for a LED strip, wherein each individual light source may be controlled according to a different light setting.

U.S. patent application 2016/0123541 A1 discloses a wirelessly controllable lamp which includes a plurality of solid-state emitters. The solid-state emitters of the lamp may be individually addressable and/or addressable in one or more groupings, and thus can be electronically controlled individually and/or in conjunction with one another.

SUMMARY OF THE INVENTION

The inventors have realized that if an LED strip with individually addressable (and individually controllable) light sources is to be controlled via a network, many individual control signals may be required for controlling each of these individual light sources. This generates a lot of network traffic, and may therefore have a strong impact on the utilization of the (wireless) network. Also, the system architecture of the networked lighting system may not support a large number of control signals during a specific period of time. It is therefore an object of the present invention to reduce the number of control signals communicated via the network while controlling an LED array with individually addressable light sources.

According to a first aspect of the present invention, the object is achieved by a lighting system for controlling an LED array, the lighting system comprising:

the LED array comprising a plurality of individually addressable light sources each having an individual address, a processor configured to divide the plurality of individually addressable light sources into a plurality of segments of light sources by assigning segment addresses to the segments of light sources, wherein each segment comprises a unique set of one or more light sources, wherein the LED array further comprises a receiver configured to receive a plurality of lighting control signals via a network, wherein each lighting control signal is addressed to one of the segment addresses, and wherein the LED array further comprises a controller configured to control at least one of the individually addressable light sources of each segment according to the lighting control signal addressed to the respective segment.

The processor is configured to divide the plurality of individually addressable light sources of the LED array into a plurality of segments of light sources by assigning segment addresses to the segments of light sources. This is beneficial, because it reduces the number of network addresses in the lighting system. By dividing the led string into the plurality of segments, a lighting control device (e.g. a smartphone, a bridge, a light switch, a building management system, etc.) may 'see' the LED array not as an array with individually controllable light sources, each with its own address, but as a few addressable light sources/lighting devices. Thus, the lighting control device may (only) control the segments of the LED array, and not the individually addressable light sources. 'Fooling'/'treating' the lighting control device in such a way is beneficial, because it reduces the number of lighting control signals that are transmitted over the (wireless) network for controlling the LED array. This may, for example, be beneficial in lighting control systems wherein the maximum number of addressable devices is limited. Examples of such lighting control systems include but are not limited to lighting control systems that use Wi-Fi, ZigBee and/or Bluetooth for communicating lighting control signals to lighting devices (such as LED arrays).

This invention may furthermore improve the usability of controlling the LED strip with individually controllable (addressable) light sources. A user interface of a lighting control device may for example display the segments as individual devices, enabling the user to control segments of the LED array as individual lighting devices (and thereby removing the need for providing control signals for each individual light source).

The processor may change the number and/or size (the size being the number of individually addressable light sources in a segment) of the segments dynamically (e.g. over time based on input parameters). Changing the number and/or the size of the segments dynamically is beneficial, because it enables the processor to optimize the control performance for each situation. The processor may be configured to change the number and/or the size of the segments based on one or more parameters, which will be described below.

In embodiments of the lighting system, the processor is further configured to receive an indication of a network capacity of the network, and the processor is further configured to determine a number of segments based on the network capacity. The network capacity may be based on a maximum number of messages that can be accommodated by the network within a predetermined time period and/or based on how many devices can be connected to the network. It is advantageous when the processor has access to information about the network capacity, because it enables the processor to determine a number of segments and/or the segment size(s) for the LED array such that a number of control signals required for controlling the LED array does not exceed the network capacity.

In embodiments of the lighting system, the processor is further configured to receive an indication of a network utilization relative to a predetermined network capacity, and the processor is further configured to determine a number of segments based on the indication of the network utilization. In this embodiment the processor has access to information about the current network traffic and the maximum network traffic. The processor may be arranged for receiving information about the network utilization from a device in the network (e.g. from a lighting device, a router, a hub, a smart device, a bridge, etc.). Tracking the amount of data that is transferred within the network is advantageous because it enables the processor to make a sophisticated decision of how to divide the LED array into the plurality of segments. This further enables dynamic change of the number and/or size of the segments.

In embodiments of the lighting system, the processor is further configured to receive an instruction signal from a lighting control device, which instruction signal comprises instructions for dividing the plurality of individually addressable light sources into the plurality of segments of light sources, and the processor is further configured to divide the plurality of individually addressable light sources into the plurality of segments of light sources based on the instruction signal. The processor may, for example, be comprised in the LED array. It may be beneficial if the processor receives the instruction signal from a lighting control device such as a bridge or a smart device, because it enables configuration of the LED array by the lighting control device.

In embodiments of the lighting system, the processor is further configured to generate information about a current division of the plurality of individually addressable light sources, and the processor is further arranged for communicating the information about the current division to a lighting control device. This embodiment is advantageous, because it enables the processor to inform a lighting control device (such as a smartphone or a bridge) about the current segmentation of the LED array.

In embodiments of the lighting system, the LED array is mounted on a flexible carrier, and the processor is further configured to receive one or more signals indicative of a shape formed by the LED array, and the processor is further configured to divide the plurality of individually addressable light sources into the plurality of segments of light sources based on the shape. For example, a LED array may be provided with one or more sensors (e.g., an array of electrodes) configured to provide one or more signals indicative of a shape into which the LED array is formed. When a deformation such as a bend is introduced into the LED array, the deformation may be detected based on a change in the signals provided by the one or more sensors. The deformation may be indicative of how the LED array has been attached to an object (e.g. bent around a corner). For example a change in impedance (e.g., capacitive or resistive) between two or more electrodes may indicate a deformation in the flexible LED array at that location. Based on this deformation, the processor may determine how to divide the plurality of individually addressable light sources into the plurality of segments of light sources. The segmentation may be communicated to a lighting control device. This is beneficial, because the division of the LED array into the segments is easily perceivable for a user.

In embodiments of the lighting system, the processor is further configured to receive one or more signals indicative of orientations of one or more of the individually addressable light sources, and configured to divide the plurality of individually addressable light sources into the plurality of segments of light sources based on the orientations. The orientation of the one or more of the individually addressable light sources may be indicative of how the LED array has been attached to an object (e.g. bent around a cabinet). If the individually addressable light sources have a similar orientation, the processor may add these to a segment of the LED strip. This is beneficial, because the division of the LED array into the segments is easily perceivable for a user.

In embodiments of the lighting system, the network is a mesh network, and the receiver is configured to receive the plurality of lighting control signals from a plurality of nodes in the mesh network. The receiver may, for example, receive a first lighting control signal addressed to a first segment from a first node and a second lighting control signal addressed to a second segment from a second node. The mesh network may distribute the lighting control signals amongst the nodes such that the lighting control signals reach the LED array via different routes.

In embodiments of the lighting system, the controller is configured to embed a code in the light output of each of the individually addressable light sources such that individually addressable light sources of a first segment emit light comprising a first code and that individually addressable light sources of a second segment emit light comprising a second code. This enables a further device, such as a lighting control device, to detect the codes (e.g. by a light detector such as a camera) and thereby determine how the LED array has been segmented. This further enables the LED array to communicate different information per segment.

In embodiments of the lighting system, the processor is comprised in the LED array. Alternatively, the processor may be comprised in a further device, such as a smart device (such as a mobile phone), in a bridge, in a building management system, etc.

In embodiments of the lighting system, the receiver is configured to:

receive a first lighting control signal addressed to a first segment, the first lighting control signal comprising first color information, receive a second lighting control signal addressed to a second segment, the second lighting control signal comprising second color information, and the controller is further configured to:

form from the first color information and the second color information a color gradient pattern, map the color gradient pattern on at least a part of the first segment and on at least a part of the second segment, and control the individually addressable light sources according to the mapped color gradient pattern. Embodiments of the invention thus provide a lighting system capable of generating a custom color gradient pattern based on a set of at least two received light output colors, and controlling the LED array to display the thus generated pattern. The controller may be configured to devise a spatial pattern of color points comprised from the received colors addressed to the first and the second segments, and to form the gradient pattern based on this pattern of points. In particular, the controller may assign each of the received colors to one or more location points within a pattern space on each of the segments, and form a pattern of color points based on these assigned location values. The thus formed pattern of color points provides a skeleton or frame based upon which the full gradient pattern may then be created. In particular, the controller may interpolate an ordered set of further light output colors for filling spaces between each of the assigned color points, the further colors together defining a gradated transition between each pair of neighboring color points.

In further embodiments of the lighting system, the receiver is further configured to receive pattern configuration information comprising one or more constraints, and the controller is further configured to form the color gradient pattern based on said constraints. Said constraints may in particular non-limiting examples (to be described in greater detail in passages to follow) comprise at least one of:

- a smoothness parameter, defining a smoothness of a color transition from a first color of the first color information to a second color of the second color information,
- color information of one or more mid-points in between two end-points of the color gradient pattern, and
- location information of one or more mid-points in between two end-points of the color gradient pattern.

According to a second aspect of the present invention, the object is achieved by a method of controlling a LED array comprising a plurality of individually addressable light sources each having an individual address, the method comprising:

- dividing the plurality of individually addressable light sources into a plurality of segments of light sources by assigning segment addresses to the segments of light sources, wherein each segment comprises a unique set of one or more light sources,
- receiving a plurality of lighting control signals via a network, wherein each lighting control signal is addressed to one of the segment addresses, and
- controlling at least one of the individually addressable light sources of each segment according to the lighting control signal addressed to the respective segment.

According to a third aspect of the present invention, the object is achieved by a computer program product for a computing device, the computer program product comprising computer program code to perform the above-mentioned method when the computer program product is run on a processing unit of the computing device.

It should be understood that the claimed method and/or computer program product may have similar and/or identical embodiments and advantages as the claimed lighting system.

The term "lighting control device" in the present invention may refer to any type of lighting control device that is, directly or indirectly, communicatively coupled to the LED array. Examples of lighting control devices include but are not limited to smart devices such as smartphones, smart watches/rings and smart glasses, central control systems such as home/office automation systems, routing or bridging devices such as routers or bridges, light switches, dimmer switches and sensors.

BRIEF DESCRIPTION OF THE DRAWINGS

The above, as well as additional objects, features and advantages of the disclosed mobile devices and methods will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
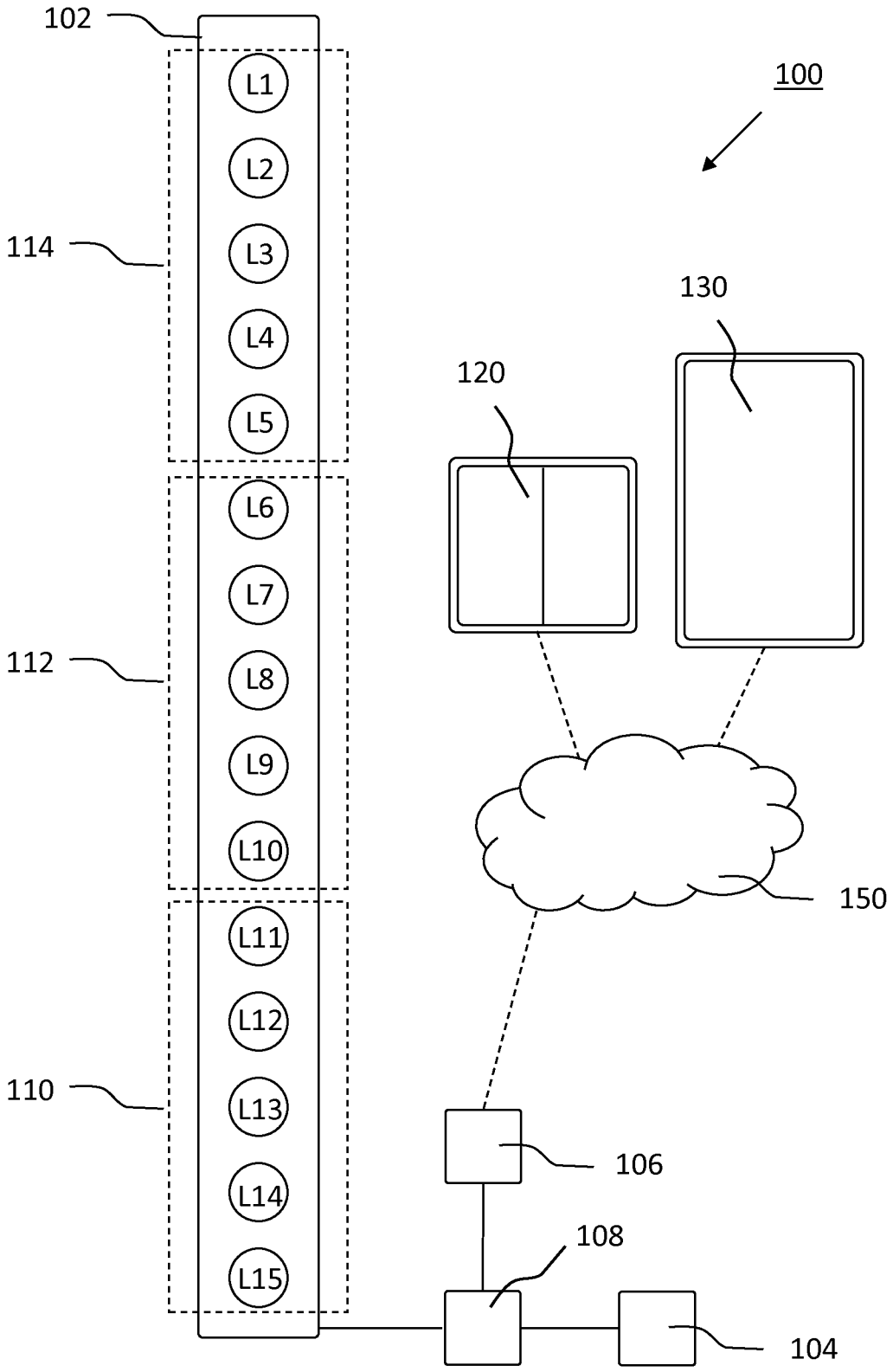
FIG. 1 shows schematically an embodiment of a lighting system according to the invention for controlling an LED array.

FIG. 1 shows schematically an embodiment of a lighting system 100 for controlling an LED array 102. The LED array 102 comprises a plurality of individually addressable light sources L1-L15 each having an individual address. The LED array may, for example, be an LED strip, a (wall) panel comprising a 2D LED array, a 3D LED array, etc. The lighting system further comprises a processor 104 (e.g. a microcontroller, a microchip, circuitry) configured to divide the plurality of individually addressable light sources L1-L15 into a plurality of segments 110, 112, 114 of light sources by assigning segment addresses to the segments of light sources, wherein each segment comprises a unique set of one or more light sources. The LED array 102 further comprises a receiver 106 configured to receive a plurality of lighting control signals via a network 150, wherein each lighting control signal is addressed to one of the segment addresses. The LED array 102 further comprises a controller 106 configured to control (at least one of) the individually addressable light sources of each segment according to the lighting control signal addressed to the respective segment.

The processor 104 is configured to divide the plurality of individually addressable light sources L1-L15 into a plurality of segments 110, 112, 114 of light sources by assigning segment addresses to the segments of light sources, wherein each segment comprises a unique set of one or more light sources. A segment, in other words, may be a group of individually addressable light sources. Each of the individually addressable light sources may have a unique network address. The processor 104 may create new network addresses for each segment. In the example of FIG. 1, the processor 104 may divide the LED array 102 into three (equal) segments (segment 110 which comprises light sources L1-L5, segment 112 which comprises light sources L6-L10 and segment 114 which comprises light sources L11-L15) by assigning unique network addresses to each of the segments.

The processor 104 may be coupled to a transmitter for communicating the segment addresses to a lighting control device 120, 130 (e.g. a smartphone, a bridge, a light switch, a home automation system, etc.). The lighting control device 120, 130 may receive these segment addresses, and be thereby configured to control the LED array by transmitting lighting control signals (only) to these segment addresses. This may, for example, be beneficial in lighting control networks wherein the maximum number of addressable devices is limited.

The processor 104 may be comprised in the LED array 102. As will be clear from embodiments described below, it may be beneficial if the LED array 102 is able to determine (how) to divide the plurality of individually addressable light sources into the plurality of segments. Alternatively, the processor 104 may be comprised in another device, for example a bridge, a lighting control device (e.g. a smart device), a home automation system, etc. As will be clear from embodiments described below, it may be beneficial if a further device is able to determine (how) to divide the plurality of individually addressable light sources into the plurality of segments. In embodiments, the processor 104 and the controller 108 may be the same component.

The LED array 102 comprises a plurality of LED light sources L1-L15. Each light source may comprise a single light emitter (e.g. a white or a colored LED) or comprise a plurality of light emitters (e.g. three emitters (RGB) or four emitters (RGBW)). The LED array 102 may be configured to provide general lighting, task lighting, ambient lighting, atmosphere lighting, accent lighting, indoor lighting, outdoor lighting, etc.

The LED array 102 comprises a receiver 106 configured to receive the plurality of lighting control signals via the network 150, wherein each lighting control signal is addressed to one of the segment addresses 110, 112, 114. A lighting control signal may comprise instructions for the controller 108 for controlling the light sources of the respective segment according to a color, saturation and/or brightness. The instructions may, for example, comprise color values (e.g. in the CIE color space). The controller 108 is configured to control the individually addressable light sources of each segment according to the lighting control signal addressed to the respective segment based on the instructions comprised in the lighting control signals. In embodiments wherein the processor 104 is comprised in a further device, the receiver 106 may be further arranged for receiving information about how the plurality of individually addressable light sources have been divided. In embodiments wherein the processor 104 is comprised in the LED array 102, the receiver 106 may be a transceiver, further arranged for communicating information about how the plurality of individually addressable light sources have been divided to devices connected via the network 150.

The receiver 106 (or transceiver) of the LED array 106 may comprise hardware for communicating with other devices on the network 150 via any wired or wireless communication protocol. Various wired and wireless communication protocols may be used for network communication, for example Bluetooth, Wi-Fi, Li-Fi, 3G, 4G, ZigBee, Ethernet, DMX, DALI and/or USB. A specific communication technology may be selected based on the communication capabilities of the LED array, the power consumption of the communication driver for the (wireless) communication technology and/or the communication range of the signals.

The LED array 102 further comprises a controller 108 configured to control the individually addressable light sources of each segment according to the lighting control signal addressed to each respective segment. The controller is configured to receive the lighting control signals from the receiver 106, whereupon it determines which lighting control signal should be applied to which light source. The receiver 106 in FIG. 1 may, for example, receive three lighting control signals from the smartphone 130 via the network 150. A first lighting control signal (which may comprise control instructions for setting the light output to blue) may be addressed to a first segment 110, a second lighting control signal (which may comprise control instructions for setting the light output to white) may be addressed to a second segment 112 and third lighting control signal (which may comprise control instructions for setting the light output to red) may be addressed to a third segment 114. The controller 108 may receive these lighting control signals from the receiver 106, whereupon the controller may control light output of the light sources L11-L16 according to the lighting control signal addressed to the first segment 110 (blue light), control light output of the light sources L6-L10 according to the lighting control signal addressed to the second segment 112 (white light) and control light output of the light sources L1-L5 according to the lighting control signal addressed to the third segment 114 (red light).

Figure 2A:
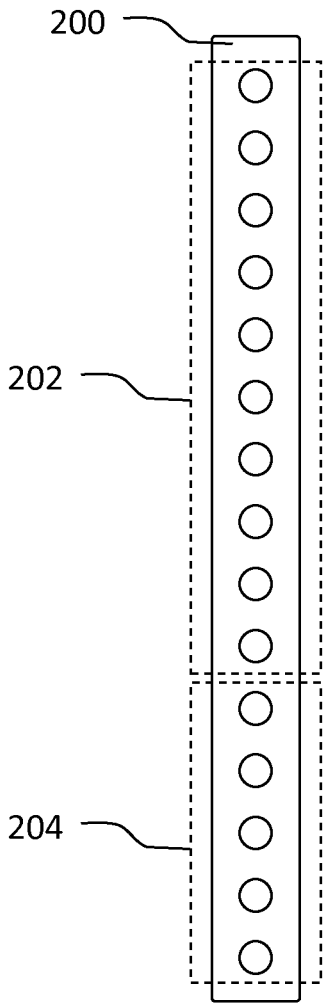
FIGS. 2*a-c* show schematically embodiments of LED arrays according to the invention.
Figure 2B:
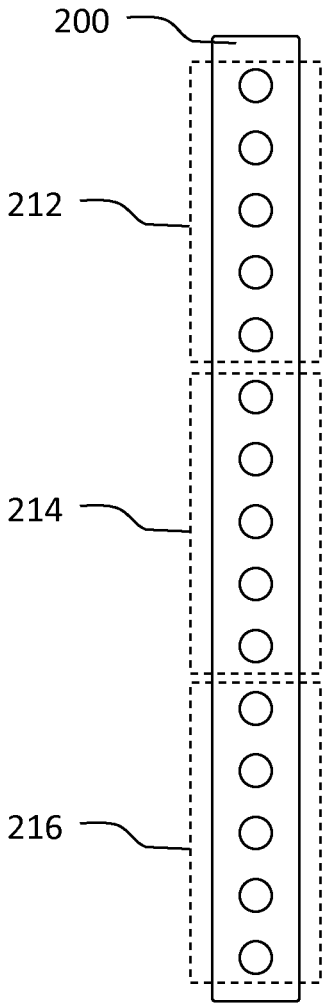
Figure 2C:
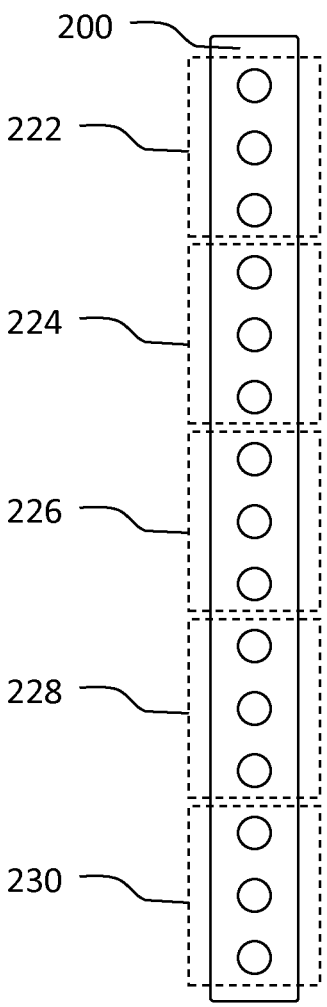

The processor 104 may be configured to receive an indication of a network capacity of the network 150. The indication of the network capacity may be related to the bandwidth of the network, the network load, download speed of the network, etc. The network capacity may be indicative of a maximum number of (type of) control signals that can be accommodated by the network 150. The processor 104 may be further configured to determine a number and/or size of segments based on the network capacity in order to assure that each by a lighting control device 120, 130 transmitted control signal will be received by the receiver 106 of the LED array 102. FIGS. 2*a*-2*c* illustrate examples of different divisions of an LED array 200, 210, 220. The processor (not shown in FIGS. 2*a*-2*c*) may, for example, receive an indication of a network capacity of the network 150 indicative of a low network capacity, and therefore divide the LED array 200 into two segments 202, 204 (which segments do not necessarily need to have the same size). If the network capacity is higher, the processor may determine to divide the LED array 200 into three segments 212, 214, 216 or even into more segments 222, 224, 226, 228, 230 for an even higher network capacity.

The processor 104 may be further configured to receive an indication of a network utilization relative to a predetermined network capacity and to determine a number of segments based on the indication of the network utilization. The network utilization may be based on a current number and/or type of messages, signals or data packets that are accommodated by the network 150 at a specific point in time. If the network utilization is high, the processor 104 may determine to divide the LED array 102 in a higher number of segments compared to when the network utilization is low. This is beneficial because it allows the processor to use the network optimally without exceeding its capacity.

The processor 104 may be further configured to receive an instruction signal from a lighting control device, which instruction signal comprises instructions for dividing the plurality of individually addressable light sources into the plurality of segments of light sources. The processor 104 may be comprised in the LED array 102. The receiver 106 of the LED array may be configured to receive the instruction signal. Upon receiving the instruction signal, the processor 104 may divide the plurality of individually addressable light sources into the plurality of segments of light sources based on the instruction signal. The lighting control device may, for example, be a bridge (or any other central control system), which may connect another lighting control device, such as a smartphone, to the LED array 102. The bridge may communicate the instruction signal to the LED array 102, and the bridge may further communicate information about the segment addresses to the other lighting control device (e.g. the smartphone). This enables the bridge (or any other central control system) to determine how to segment the LED array 102.

The lighting control device may comprise a processing unit configured to generate the instruction signal. The instruction signal may be indicative of many segment addresses which have been assigned by the lighting control device to the LED array 102. Additionally or alternatively, the instruction signal may be indicative of a spatial distribution of the segments relative to the LED array. Based on the instruction signal, the processor 104 may determine a number and/or a position of addressable segments of the LED array 102. The number of segment addresses may be determined by the lighting control device. The number of segment addresses may depend on, for example, a (current) network capacity, a maximum number of addresses available in the network/available to the lighting control device, etc. Additionally or alternatively, the lighting control device may determine the number of segment addresses based on a desired resolution of the light emission of the LED array. For instance, a low resolution may be desirable when the LED array is used for ambient and/or indirect lighting, wherein only a few colors are desired. In another example, a high resolution may be desirable, for instance when the LED array is controlled based on image content. The lighting control device 120, 130 may be configured to transmit the instruction signal with a transmitter to a processor of the LED array. The lighting control device may be further configured to receive an indication of a network capacity of the network, and the lighting control device may be further configured to generate the instruction signal based on the network capacity.

The lighting control device may be further configured to receive an indication of a network utilization relative to a predetermined network capacity, and the lighting control device may be further configured to generate the instruction signal based on the network capacity.

Additionally or alternatively, the processor 104 may be further configured to generate information about a current division of the plurality of individually addressable light sources. After dividing the plurality of individually addressable light sources of the LED array 102 into the segments, the information about the current division may be communicated to a further device, for example a lighting control device. The processor 104 may be communicatively coupled to a transmitter arranged for transmitting the information about the current division.

Figure 3:
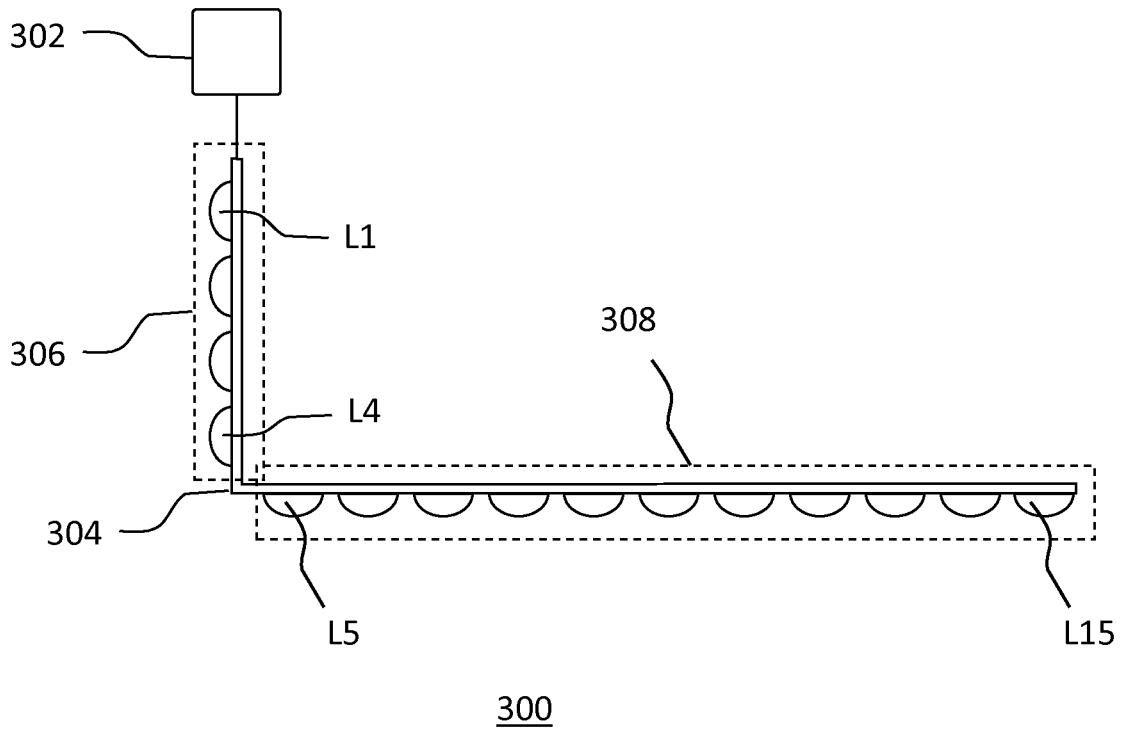
FIG. 3 shows schematically an embodiment of an LED array according to the invention.

The plurality of light sources of the LED array 102 may be mounted on a flexible carrier (also called a flexible LED strip). The processor 104 may be further configured to receive one or more signals indicative of a shape formed by the LED array. The processor 104 may be further configured to divide the plurality of individually addressable light sources into the plurality of segments of light sources based on the shape. For example, the LED array 102 may comprise one or more sensors (e.g. an array of electrodes) configured to provide one or more signals indicative of a shape into which the flexible lighting strip is formed. When a deformation such as a bend, twist or stretch is introduced into the LED array, the deformation may be detected based on a change in the signals provided by the one or more sensors. For example, a change in impedance (e.g., capacitive or resistive) between two or more electrodes may indicate a deformation in the LED array at that location, whereupon the processor 104 may divide the LED array 102 based on the deformation. FIG. 3 illustrates an example of such an LED array 300. The LED array 300 may comprise a plurality of sensors (for example in between each pair of light sources) and a plurality of light source (L1-L15, of which only L1, L4, L5 and L15 have reference numbers in FIG. 3). A sensor (not shown) located at location 304 may detect a deformation at that location, which deformation may be communicated to the processor 302. The processor 302 may thereafter divide the LED array 300 into two segments 306 (comprising light sources L1-L4) and 308 (comprising light sources L5-L15), each with its own address.

Additionally or alternatively, the processor may be configured to receive one or more signals indicative of orientations of one or more of the individually addressable light sources. The processor 104 may be further configured to divide the plurality of individually addressable light sources into the plurality of segments of light sources based on the orientations. The LED array may comprise one or more orientation sensors (e.g. gyroscopes, magnetometers, etc.) configured to detect the orientation of one or more parts of the LED array. In the example of FIG. 3, each of the light sources L1-L15 may comprise an orientation sensor. These orientation sensors may be communicatively coupled to the processor 302 so as to inform the processor about the orientations. Orientation sensors of the light sources L1-L4 in area 306 may communicate a horizontal orientation to the processor 302, whereas orientation sensors of the light sources L5-L15 in area 308 may communicate a vertical orientation to the processor 302. The processor 302 may thereafter divide the LED array 300 into two segments 306 (comprising light sources L1-L4) and 308 (comprising light sources L5-L15), each with its own address.

In embodiments, the network 150 may be a mesh network, and the receiver 106 may be configured to receive the plurality of lighting control signals from a plurality of nodes in the mesh network. The receiver 106 may, for example, receive a first lighting control signal addressed to a first segment from a first node and a second lighting control signal addressed to a second segment from a second node. The mesh network may be configured to distribute the lighting control signals amongst the nodes such that the lighting control signals reach the LED array via different routes.

The controller 108 may be further configured to embed a code in the light output of each of the individually addressable light sources such that individually addressable light sources of a first segment emit light comprising a first code and that individually addressable light sources of a second segment emit light comprising a second code. The code may be created by any known principle of embedding a code in light, for example by controlling a time-varying, modulated current to the one or more light sources to produce variations in the light output, by modulating the amplitude and/or the duty-cycle of the light pulses, etc. In the example of FIG. 1, the controller may control the light sources L1-L5 of a first segment 114 such that they emit light comprising a first code, control the light sources L6-L10 of a second segment 112 such that they emit light comprising a second code and control the light sources L11-L15 of a third segment 110 such that they emit light comprising a third code. The embedded codes may comprise identifiers indicative of the segments. The embedded codes may be detected by a lighting control device, such as a smartphone. The lighting control device may comprise a detector (e.g. a camera) for detecting the different codes embedded in the light. This enables the lighting control device to identify the different segments of the LED array 102, and, due to the different codes, distinguish between the different segments. A user interface of the lighting control device (e.g. a (touch sensitive) screen) may be configured to inform a user operating the lighting control device about the division. The user interface may further comprise a user input means for selecting one or more of the segments and/or for controlling the light output of one or more of the segments. Embedding a code in the different segments further enables communicating different information per segment. Segments may, for example, communicate information about their current light setting, information about their position relative to the LED array, information about their position relative to a space, information about the type of light sources, etc.

The lighting control device 120, 130 may comprise a user interface configured to receive user input indicative of an adjustment of the light output (light setting) of the LED array 102. The user input device may comprise any type of user interface arranged for receiving user input. The user interface may for example comprise a touch-sensitive device such as a touchpad, a touchscreen, one or more buttons and/or one or more sliders for receiving touch input. Additionally or alternatively, the user interface may comprise a microphone arranged for receiving voice commands from the user operating the first device, which voice commands may be indicative of a selection and/or control of one or more of the segments. Additionally or alternatively, the user input element may comprise a gesture/motion detection means, such as a gyroscope and/or an accelerometer arranged for detecting gestures made with the lighting control device, which gestures may be indicative of a selection and/or control of one or more of the segments. Examples of such gestures are shaking or changing the orientation of the lighting control device. It should be noted that the above-mentioned user input elements are mere examples of user input elements and illustrate rather than limit the invention, and that those skilled in the art will be able to design many alternative user input elements without departing from the scope of the appended claims.

Figure 4:
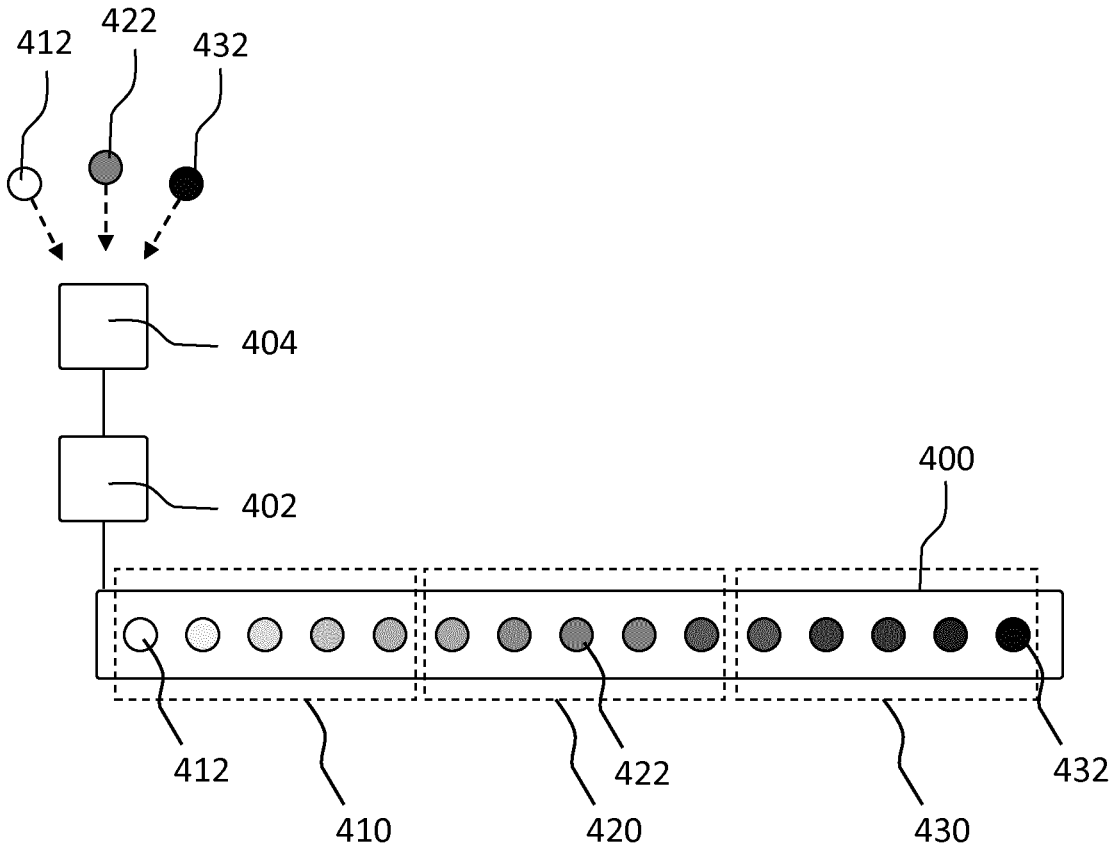
FIG. 4 shows schematically an embodiment of an LED array according to the invention, wherein the LED array comprises a controller for applying a color gradient pattern to the LED array.

The receiver 106 may be further configured to receive lighting control signals addressed to segments, wherein the received lighting control signals comprise color information. The controller 108 may be further configured to a color gradient pattern from the color information and map the color gradient pattern on the respective segments. The controller 108 may be arranged to map the gradient such that at least one light source of a segment is controller according to the color comprised in the control signal addressed to that segment. An example of such an LED array is illustrated in FIG. 4. FIG. 4 shows schematically an embodiment of an LED array 400 according to the invention, wherein the LED array 400 comprises a controller 402 for applying a color gradient pattern to the LED array 400. In this example, the receiver 404 may receive three control signals 412, 422 and 432 addressed to segments 410, 420 and 430, respectively. The control signals comprise color information, for example yellow, orange and red. In the example of FIG. 4, control signal 412 comprises yellow color information, control signal 422 comprises orange color information and control signal 432 comprises red color information. The controller 402 may be configured to form, from the color information, a color gradient pattern and to map the color gradient pattern on the different segments. In the example of FIG. 4, the controller may map the yellow color to the first LED 412 of the first segment 410 of the LED array 400, map the orange color to the center LED 422 of the second segment 420 of the LED array 400 and map the red color to the last LED 432 of third segment 430 of the LED array 400. The controller 402 may be further configured to interpolate light output colors for the LEDs in between the first LED 412, the center LED 422 and the last LED 432, such that a gradient pattern is realized.

The receiver 106 may be further configured to receive pattern configuration information comprising one or more constraints, and the controller 108 may be further configured to form the color gradient pattern based on said constraints.

An example of a constraint comprised by the pattern configuration information may be locations of one or more mid-points of the gradient pattern, mid-points representing mid-points in a color transition from a first color to a second color. For example, a received constraint might indicate that a mid-point should be located 25% of the way between a first specified color addressed to a first segment and a second specified color addressed to a second segment. A mid-point may, for example, be a calculated color value (e.g. orange) in-between the first specified color (e.g. yellow). The controller 108 may then be configured to interpolate the further light output colors between said specified colors such that at a point 25% of the way between these two colors, the color of the gradient pattern changes from being predominantly of the first color to being predominantly of the second color. Of course, 25% represents just one example of a location for a mid-point, and in further examples, constraints may specify any relative or absolute location of such a mid-point.

Additionally or alternatively, the one or more constraints may comprise color information of one or more mid-points in between two end-points of the color gradient pattern. The end-points may, for example, be end-points of segments. The constraint may, for example, comprise color information indicative of a blue color. The color information comprised in the control signals addressed to a first and a second segment may be for example be indicative of the colors yellow and red, respectively. The controller 108 may be configured to create a color gradient pattern from yellow, to blue, to red and map this color gradient pattern to the LED array such that at least one light source (the first end-point) of the first segment is yellow and such that at least one light source (the second end-point) is red.

Additionally or alternatively, the one or more constraints may comprise a smoothness parameter, defining a smoothness of a color transition provided by at least a portion of the further light output colors. The smoothness of a color transition may be determined by the number of further light output coolers forming the color transition. In particular, a large number of further colors populating the transition will provide a smoother color transition; a smaller number of further colors will provide a more disjointed or discretized color transition. A high density gradient pattern comprising a large number of transitionary colors provides a high resolution (or smooth) gradient pattern, a low density pattern provides a lower resolution (or less smooth) gradient pattern.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A lighting system for controlling a lighting device, the lighting system comprising:

the lighting device comprising a plurality of individually addressable light sources each having an individual address, a processor configured to divide the plurality of individually addressable light sources into a plurality of segments of light sources by assigning segment addresses to the segments of light sources, wherein each segment comprises a unique set of one or more light sources, wherein the lighting device further comprises a receiver configured to receive a plurality of lighting control signals via a network wherein each lighting control signal is addressed to one of the segment addresses, and wherein the lighting device further comprises a controller configured to control at least one of the individually addressable light sources of each segment according to the lighting control signal addressed to the respective segment, and wherein the processor is configured to receive an instruction signal from a lighting control device, which instruction signal comprises instructions for dividing the plurality of individually addressable light sources into the plurality of segments of light sources, and to divide the plurality of individually addressable light sources into the plurality of segments of light sources based on the instruction signal.

2. The lighting system of claim 1, wherein the network is a mesh network, and wherein the receiver is configured to receive the plurality of lighting control signals from a plurality of nodes in the mesh network.

3. The lighting system of claim 1, wherein the controller is configured to embed a code in the light output of each of the individually addressable light sources such that individually addressable light sources of a first segment emit light comprising a first code and that individually addressable light sources of a second segment emit light comprising a second code.

4. The lighting system of claim 1, wherein the processor is comprised in the lighting device.

5. A lighting system for controlling an LED array, the lighting system comprising, the LED array comprising a plurality of individually addressable light sources each having an individual address, a processor configured to divide the plurality of individually addressable light sources into a plurality of segments of light sources by assigning segment addresses to the segments of light sources, wherein each segment comprises a unique set of one or more light sources, wherein the LED array further comprises a receiver configured to receive a plurality of lighting control signals via a network wherein each lighting control signal is addressed to one of the segment addresses, wherein the LED array further comprises a controller configured to control at least one of the individually addressable light sources of each segment according to the lighting control signal addressed to the respective segment, wherein the processor is configured to receive an instruction signal from a lighting control device, which instruction signal comprises instructions for dividing the plurality of individually addressable light sources into the plurality of segments of light sources, and to divide the plurality of individually addressable light sources into the plurality of segments of light sources based on the instruction signal, and wherein the receiver is configured to:

receive a first lighting control signal addressed to a first segment, the first lighting control signal comprising first color information, receive a second lighting control signal addressed to a second segment, the second lighting control signal comprising second color information, and wherein the controller is further configured to:

form from the first color information and the second color information a color gradient pattern, map the color gradient pattern on at least a part of the first segment and on at least a part of the second segment, and control the individually addressable light sources according to the mapped color gradient pattern.

6. The lighting system of claim 5, wherein the receiver is further configured to receive pattern configuration information comprising one or more constraints, and wherein the controller is further configured to form the color gradient pattern based on said constraints.

7. The lighting system of claim 6, wherein the one or more constraints comprises at least one of:

a smoothness parameter, defining a smoothness of a color transition from a first color of the first color information to a second color of the second color information, color information of one or more mid-points in between two end-points of the color gradient pattern, and location information of one or more mid-points in between two end-points of the color gradient pattern.

8. A lighting control device for generating the instruction signal for the processor of the lighting system of claim 7, the lighting control device being configured to generate the instruction signal, which instruction signal comprises instructions for dividing the plurality of individually addressable light sources of an LED array into the plurality of segments of light sources, wherein each segment comprises the unique set of one or more light sources and configured to transmit the instruction signal to processor of the LED array.

9. A method of controlling a lighting device comprising a plurality of individually addressable light sources, each having an individual address, the method comprising:

receive an instruction signal from a lighting control device which instruction signal comprises instructions for dividing the plurality of individually addressable light sources into a plurality of segments of light sources, dividing the plurality of individually addressable light sources into the plurality of segments of light sources by assigning segment addresses to the segments of light sources based on the instruction signal, wherein each segment comprises a unique set of one or more light sources, receiving a plurality of lighting control signals via a network wherein each lighting control signal is addressed to one of the segment addresses, and controlling at least one of the individually addressable light sources of each segment according to the lighting control signal addressed to the respective segment.

10. A computer program product for a computing device, the computer program product comprising computer program code to perform the method of claim 9 when the computer program product is run on a processing unit of the computing device.

11. The lighting control device of claim 8, wherein the lighting control device is further configured to receive an indication of a network capacity of the network, and wherein the lighting control device is further configured to generate the instruction signal based on the network capacity.

12. The lighting control device of claim 8, wherein the lighting control device is further configured to receive an indication of a network utilization of the network relative to a predetermined network capacity, and wherein the lighting control device is further configured to generate the instruction signal based on the network capacity.

13. The lighting system of claim 1, wherein the lighting device is an LED strip.

* * * * *